United States Patent [19]

Funaki

[11] Patent Number: 4,593,512

[45] Date of Patent: Jun. 10, 1986

[54] FACING MATERIAL FOR BUILDING AND METHOD FOR CONNECTING SAME

[76] Inventor: Motokatsu Funaki, 430 Shimotsuchidana, Fujisawa-shi, Kanagawa-ken, Japan

[21] Appl. No.: 636,443

[22] Filed: Jul. 31, 1984

[30] Foreign Application Priority Data

May 23, 1984 [JP] Japan ..... 59-102515

[51] Int. Cl.[4] ..... E04D 1/00

[52] U.S. Cl. ..... 52/519; 52/520; 52/539

[58] Field of Search ..... 52/518, 519, 520, 529, 52/530, 531, 539

[56] References Cited

U.S. PATENT DOCUMENTS

| | | | |
|---|---|---|---|
| 2,126,676 | 8/1938 | Thomas | 52/520 |
| 3,552,078 | 1/1971 | Mattes | 52/520 |
| 4,288,958 | 9/1981 | Chalmers et al. | 52/520 |

FOREIGN PATENT DOCUMENTS

| | | | |
|---|---|---|---|
| 493786 | 6/1953 | Canada | 52/519 |
| 209298 | 11/1966 | Sweden | 52/529 |

*Primary Examiner*—William F. Pate, III
*Assistant Examiner*—Creighton Smith
*Attorney, Agent, or Firm*—Blum Kaplan Friedman Silberman & Beran

[57] ABSTRACT

A facing material for a building is disclosed which is capable of effectively and readily carrying out the lateral connection between facing materials as well as the vertical connection. The facing material comprises a flat plate body which is formed at both side ends thereof with a side fit-in section and a side fit-on section which are adapted to be readily securely fitted with respect to the side fit-on section of a first laterally adjacent facing material and the side fit-on section of a second laterally adjacent facing material opposite to the first one. Also, a method for vertically and laterally connecting facing materials together is disclosed which is capable of readily forming an outer face of a wall or a roof of a building.

8 Claims, 9 Drawing Figures

FACING MATERIAL FOR BUILDING AND METHOD FOR CONNECTING SAME

BACKGROUND OF THE INVENTION

1. Field of the Invention

This invention relates to a facing material for a building and a method for connecting the same, and more particularly to a facing material for a roof, an outer wall or the like in a building such as a housing and a method for vertically and laterally connecting such facing materials together to form an outer face of a building such as a roof, an outer wall or the like.

2. Description of the Prior Art

A typical facing material which has been conventionally used for an outer wall of a building is disclosed in Japanese Utility Model Publication No. 53386/1983. The conventional facing material includes a laterally elongated flat plate body which has water-tight engaging portions formed at the upper and lower edges thereof in a manner to inward project from the flat plate body. The outer face of a wall of a building is formed by connecting a plurality of such adjacent facing materials to one another in order in the downward direction through the engaging portions.

However, the conventional facing material has an important difficulty that it is substantially impossible to effectively carry out the lateral connection between the adjacent facing materials.

Thus, it would be highly desirable to develop a facing material which is capable of allowing the satisfied connection to be formed between laterally adjacent facing materials as well as between the vertically adjacent facing materials.

SUMMARY OF THE INVENTION

The present invention has been made in view of the foregoing disadvantage of the prior art.

Accordingly, it is an object of the present invention to provide a facing material for a building which is capable of allowing the effective lateral connection between adjacent facing materials to be readily carried out.

It is another object of the present invention to provide a facing material simple in construction which is capable of being readily manufactured with a low cost.

It is a further object of the present invention to provide a facing material which is capable of allowing the satisfied lateral connection to be readily attained while keeping good workability in the operation of forming the outer face of a wall or a roof of a building.

It is still a further object of the present invention to provide a method for connecting facing materials which is capable of readily carrying out the satisfied lateral connection as well as the vertical connection.

In accordance with one aspect of the present invention, there is provided a facing material for a building comprising a laterally extending flat plate body having an upper fit-in section and a lower fit-on section integrally formed at the upper and lower ends thereof in a manner to inward project from said flat plate body, respectively; said upper fit-in section and lower fit-on section of said flat plate body being adapted to be respectively engaged with the lower fit-on section of an upward adjacent facing material and the upper fit-in section of a downward adjacent facing material to connect the vertically adjacent facing materials to one another; and said flat plate body also having a side fit-in section integrally formed at one side end thereof in a manner to outward project from said flat plate body and a side fit-on section integrally formed at the other side end thereof in a manner to be positioned at the inside of said flat plate body, said side fit-on section of said flat plate body being adapted to allow the side fit-in section of a laterally adjacent facing material to be securely fitted therein to connect laterally adjacent facing materials to one another.

In accordance with the present invention, there is provided a facing material for a building comprising a laterally extending flat plate body having an upper fit-in section and a lower fit-on section integrally formed at the upper and lower ends thereof in a manner to inward project from said flat plate body and extend along the entire longitudinal direction thereof, respectively; said upper fit-in section being connected to said flat plate body through an upper connection section upward inward extending from the upper end of said flat plate body and comprising a rising portion upward extending from said upper connection section and a wave-shaped portion upward extending from the upper end of said rising portion which are adapted to be fitted in the lower fit-on section of an upper adjacent facing material; said lower fit-on section being connected to said flat plate body through a lower connection section horizontally inward extending from the lower end of said flat plate body and formed into a substantially inverted U-shape to receive said upper fit-in section therein; said flat plate body also having a plate-like side fit-in section formed at one side end thereof to outward extend therefrom and a side fit-on section of a substantially U-shape in cross section formed at the other side end thereof to be positioned at the inside of said flat plate body which is adpated to receive the side fit-in section of a laterally adjacent facing material therein, said side fit-in and fit-on sections being formed along the entire vertical direction of said flat plate body; said side fit-in section being connected to said flat plate body through a first side connection section formed to inward project from said flat plate body and connected through said first side connection section and said upper connection section to said upper fit-in section; and said side fit-in section being connected to said flat plate body through a second side connection inward extending from said flat plate body.

In accordance with the present invention, there is provided a facing material for a building comprising a laterally extending flat plate body having an upper fit-in section and a lower fit-on section integrally formed at the upper and lower ends thereof in a manner to inward project therefrom and extend along the entire longitudinal direction thereof, respectively; said upper fit-in section being connected to said flat plate body through an upper connection section upward inward extending from the upper end of said flat plate body and comprising a rising portion upward extending from said upper connection section and a slanting portion outward downward extending from said rising portion; said lower fit-on section being connected to said flat plate body through a lower connection section horizontally inward extending from the lower end of said flat plate body and formed into a substantially inverted U-shape to receive the upper fit-in section of a downward adjacent facing material therein; said flat plate body also having a plate-like side fit-in section formed at one side end thereof to outward extend therefrom and a side fit-on section of a substantially U-shape in cross section formed at the other side end thereof to be positioned at the inside of said flat plate body which is adapted to securely receive the side fit-in section of a laterally adjacent facing material therein, said side fit-in and fit-on sections being formed along the entire vertical direction of said flat plate body; and said side fit-in section being connected to said flat plate body through a first side connection section formed to inward project from said flat plate body and connected through said first side connection section and said upper connection section to said upper fit-in section.

In accordance with the present invention, there is also provided a facing material for a building comprising a laterally extending flat plate body having an upper fit-in section and a lower fit-on section integrally formed at the upper and lower ends thereof in a manner to inward project from said flat plate body and extend along the entire longitudinal direction thereof, respectively; said upper fit-in section being connected to said flat plate body through an upper connection section upward inward extending from the upper end of said flat plate body and comprising a rising portion upward extending from said upper connection section and a wave-shaped portion upward extending from the upper end of said rising portion; said lower fit-on section being connected to said flat plate body through a lower connection section and formed into a substantially inverted U-shape; said lower connection section being formed to upward inward extend from the lower end of said flat plate body to allow the lower end of said flat plate body to be substantially abutted against the upper end of a flat plate body of an upward adjacent facing material when the both facing materials are vertically connected together; said flat plate body also having a plate-like side fit-in section formed at one side end thereof to outward extend therefrom and a side fit-on section of a substantially U-shape in cross section formed at the other side end thereof to be positioned at the inside of said flat plate body which is adapted to receive the side fit-in section of a laterally adjacent material therein, said side fit-in and fit-on sections being formed along the entire vertical direction of said flat plate body; said side fit-in section being connected to said flat plate body through a first side connection section formed to inward project from said flat plate body and connected through said first side connection section and said upper connection section to said upper fit-in section; and said side fit-on section being connected to said flat plate body through a second side connection section inward extending from said flat plate body.

In accordance with another aspect of the present invention, there is provided a method for connecting facing materials together in the vertical and lateral directions, comprising the steps of supporting a plurality of facing materials on a supporting means of a building to be vertically and laterally adjacent to one another; said facing materials each comprising a laterally extending flat plate body which has an upper fit-in section and a lower fit-on section integrally formed at the upper and lower ends thereof in a manner to inward project from said flat plate body and has a side fit-in section integrally formed at one side end thereof in a manner to inward project from said flat plate body and a side fit-on section integrally formed at the other side end thereof in a manner to inward project from said flat plate body; laterally and vertically connecting said facing materials together through said side fit-in and fit-on sections and said upper fit-in and lower fit-on sections.

BRIEF DESCRIPTION OF THE DRAWINGS

Other objects and many of the attendant advantages of the present invention will be readily appreciated as the same becomes better understood by reference to the following detailed description when considered in connection with the accompanying drawings in which like reference numerals designate like or corresponding parts throughout, wherein.

DETAILED DESCRIPTION OF THE PREFERRED EMBODIMENTS

Now, a facing material for a building and a method for connecting facing materials according to the present invention will be hereinafter described with reference to the accompanying drawings.

Figures 1, 2:
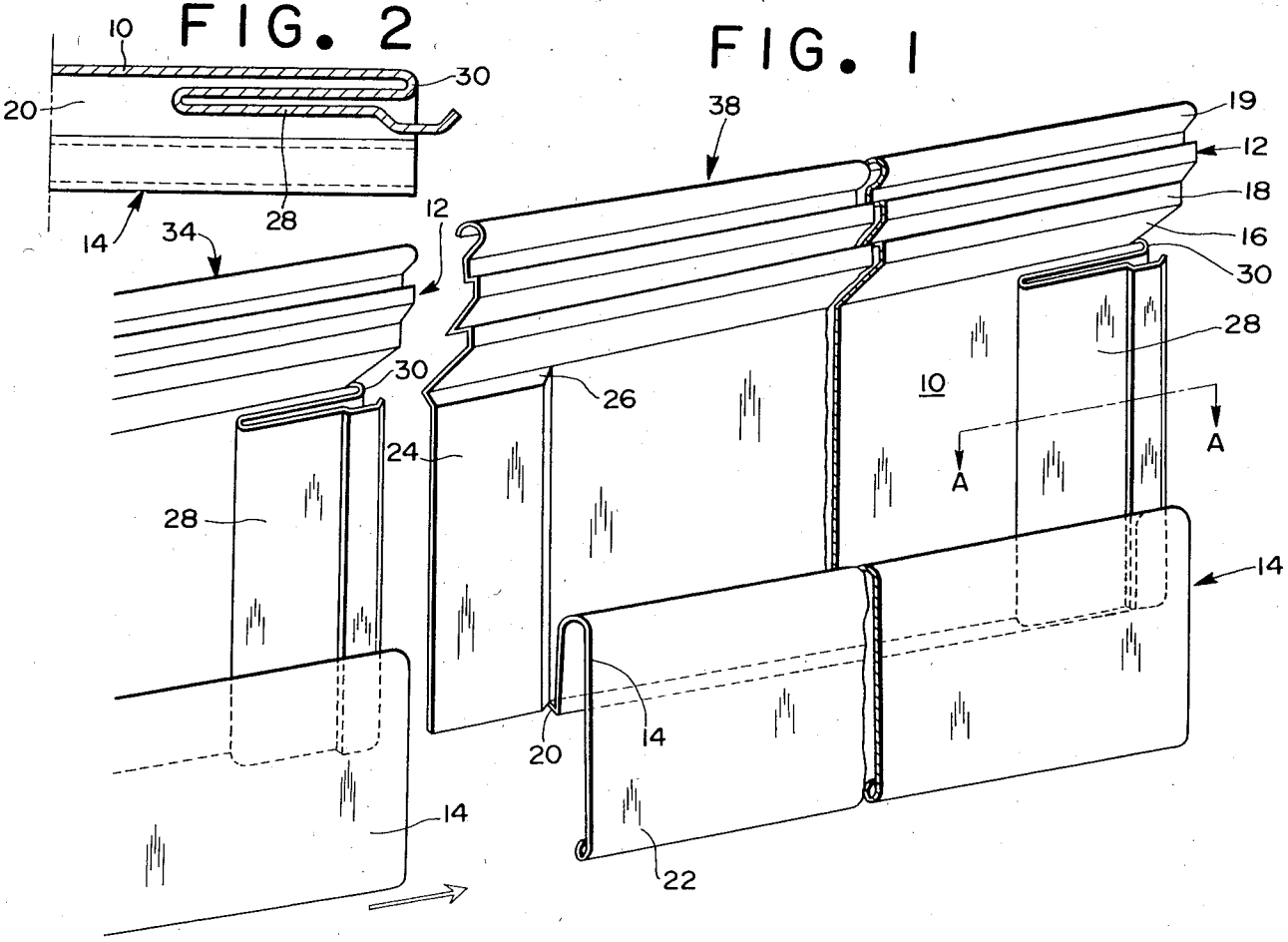
FIG. 1 is a perspective view showing one embodiment of a facing material according to the present invention wherein the facing material is viewed from the inside thereof.
FIG. 2 is a sectional view taken along line A-A of FIG. 1.
Figure 3:
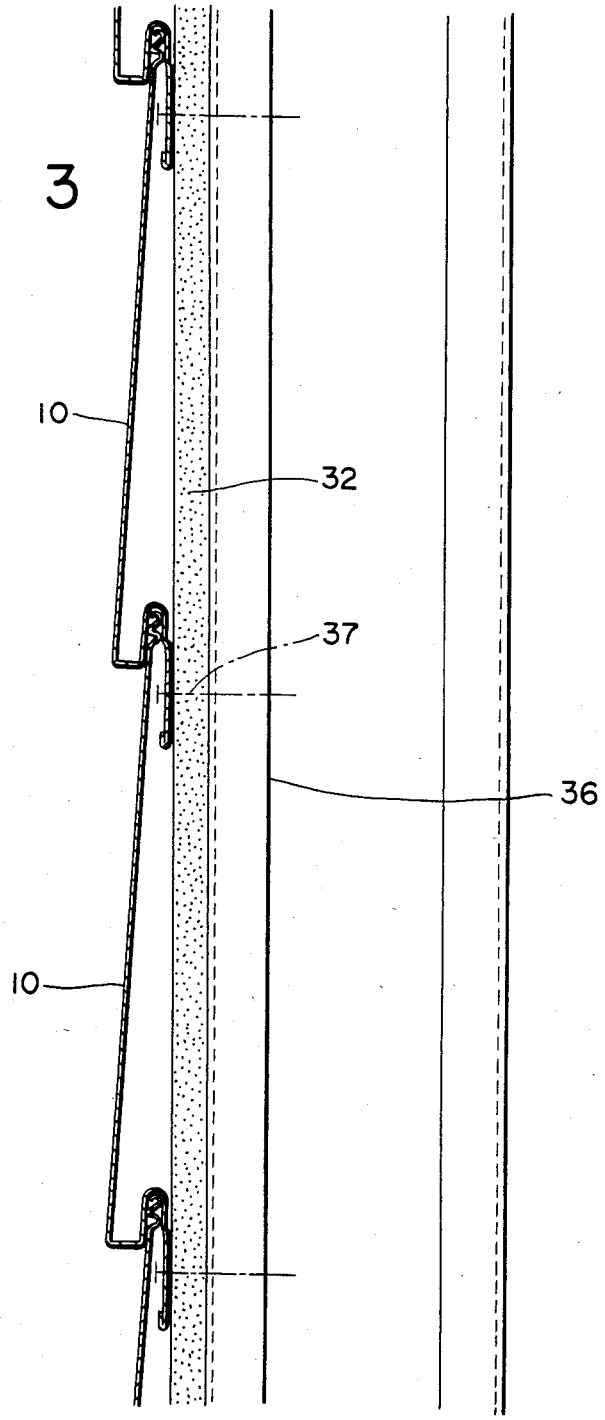
FIG. 3 is a vertical sectional view showing facing materials vertically connected together to form an outer face of a wall of a building.

FIGS. 1 and 2 illustrate a first embodiment of a facing material for a building according to the present invention. The facing material of the illustrated embodiment may be formed by bending a metal plate such as a painted steel plate or a plate formed of inflammable synthetic resin. The facing material includes a laterally extending flat plate body 10. The flat plate body 10 has an upper fit-in section 12 and a lower fit-on section 14 integrally formed at the upper and lower ends thereof in a manner to inward project from the flat plate body. In the illustrated embodiment, the upper fit-in section 12, as shown in FIGS. 2 and 3, is formed along the entire longitudinal direction of the flat plate body 10, and is connected through an upper connection section 16 upward inward extending from the upper end of the flat plate body 10 to the upper edge or end of the flat plate body 10. Also, in the illustrated embodiment, the upper fit-in section 12 comprises a rising portion 18 upward extending from the upper end of the connection section 16 to the upper edge or end of the flat plate body 10 and a substantially wave-shaped portion 19 upward extending from the upper end of the rising portion 18. The lower fit-on portion 14 of the flat plate body 10 is also formed along the entire longitudinal direction of the flat plate body 10 and is connected through a lower connection section 20 horizontally inward extending from the lower end of the flat plate body 10 to the flat plate body. The lower fit-on section 14 is formed into a substantially inverted U-shape of which the outer leg portion has a lower end 22 extending below the connection section 20. The lower connection section 20 may be formed to define a space between the flat plate body 10 and the lower fit-on section 14 which is sufficient to arrange a padding therebetween.

The facing material also has a plate-like side fit-in section 24 formed at one of the side ends of the laterally extending flat plate body 10 in a manner to laterally extend from the body 10. The side fit-in section 24 is formed along the entire vertical direction of the flat plate body 10 and connected to the flat plate body 10 through a first side connection section 26 inward projecting at a short distance from the flat plate body 10. The side fit-in section 24 is also connected at the upper end thereof to the upper fit-in section 12 through the first side connection section, and the lower end of the fit-in section 24 is positioned to be flush with the lower end of the flat plate body 10. In the illustrated embodiment, the lower fit-on section 14 does not extend to the side fit-in section 24.

The flat plate body 10 is also formed at the other side end thereof with a side fit-on section 28 of a substantially U-shape in cross section. In the embodiment, the side fit-on section 28 is formed at the inside of the flat plate body 10 and connected through a second side connection section 30 to the body 10 so as to be spaced therethrough from the body 10 at a small distance. Also, the side fit-on section 28 is provided along the overall vertical direction of the flat plate body 10 as shown in FIGS. 1 and 2 and in a manner to be interposed at the lower portion thereof between the flat plate body 10 and the lower fit-on section 14 as shown in FIG. 2.

In the illustrated embodiment, the side fit-in section 24 and side fit-on section 28 are respectively formed on the left and right sides of the flat plate body 10 when viewing from the inside of the body 10. However, it is a matter of course that the sections 24 and 28 may be positionally formed in such a manner opposite to that described hereinafter.

Now, the manner of vertically and laterally connecting the face materials each constructed in the manner as described above to one another will be hereinafter described with reference to FIGS. 1 to 7. The following description will be made in connection with the formation of an outer face of a wall of a building, however, it should be noted that the facing material is limited to the use for such an outer face of the wall.

Figure 4:
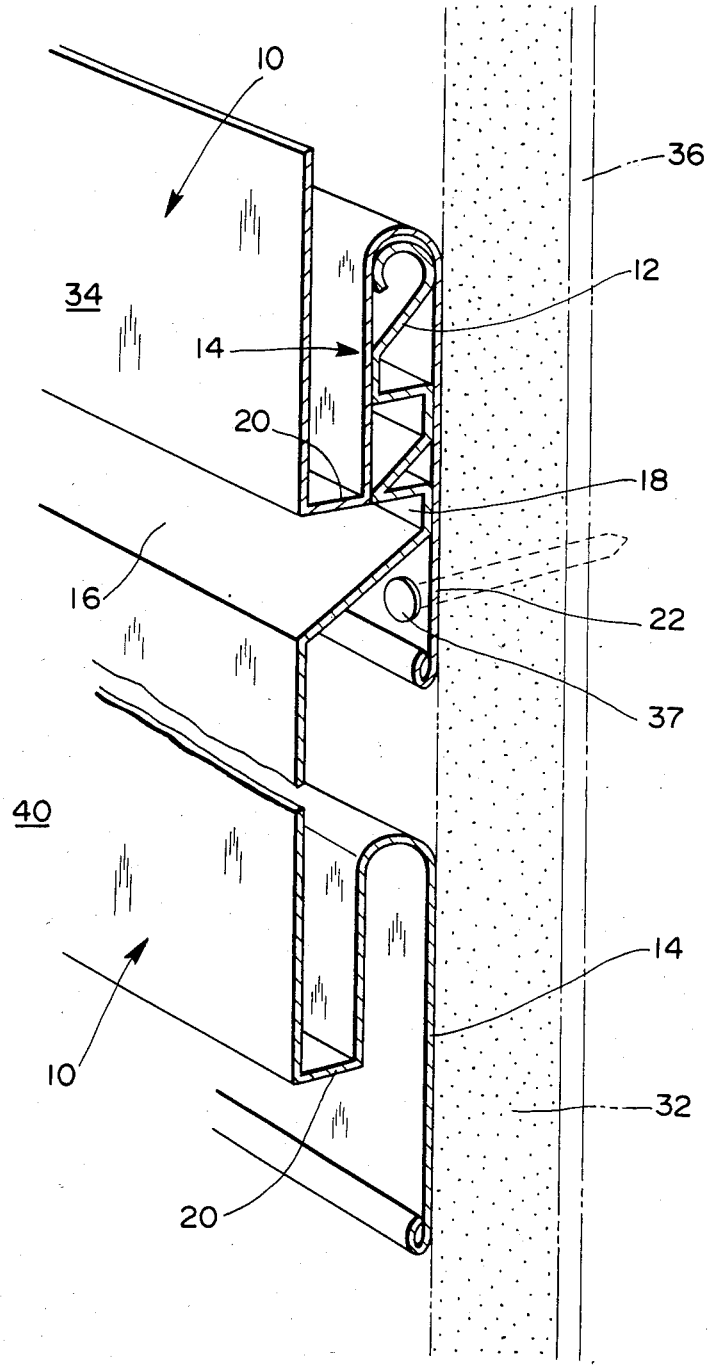
FIG. 4 is a broken sectional perspective view of the facing materials shown in FIG. 3.
Figure 5:
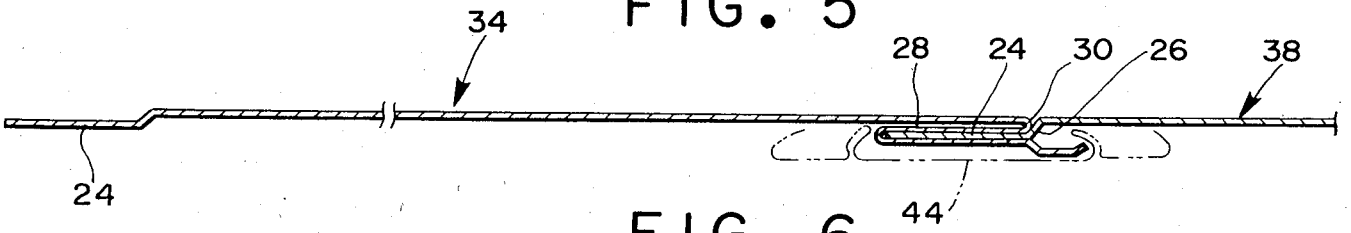
FIG. 5 is a partly broken sectional view of the facing materials shown in FIG. 3 which is viewed from the inside thereof.
Figure 6:
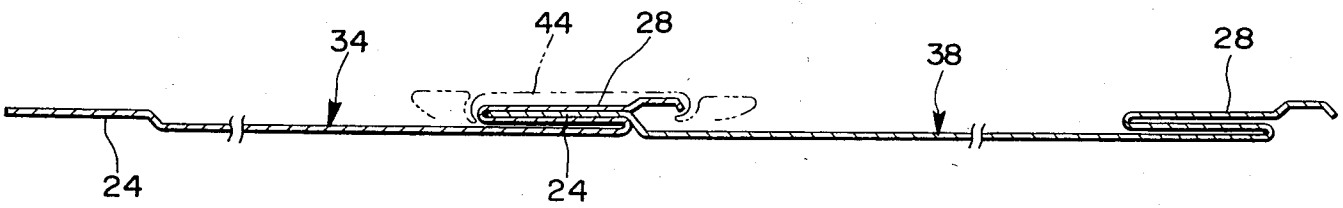
FIG. 6 is a partly broken sectional view showing a modification of side fit-in and fit-on sections of a facing material according to the present invention.
Figure 7:
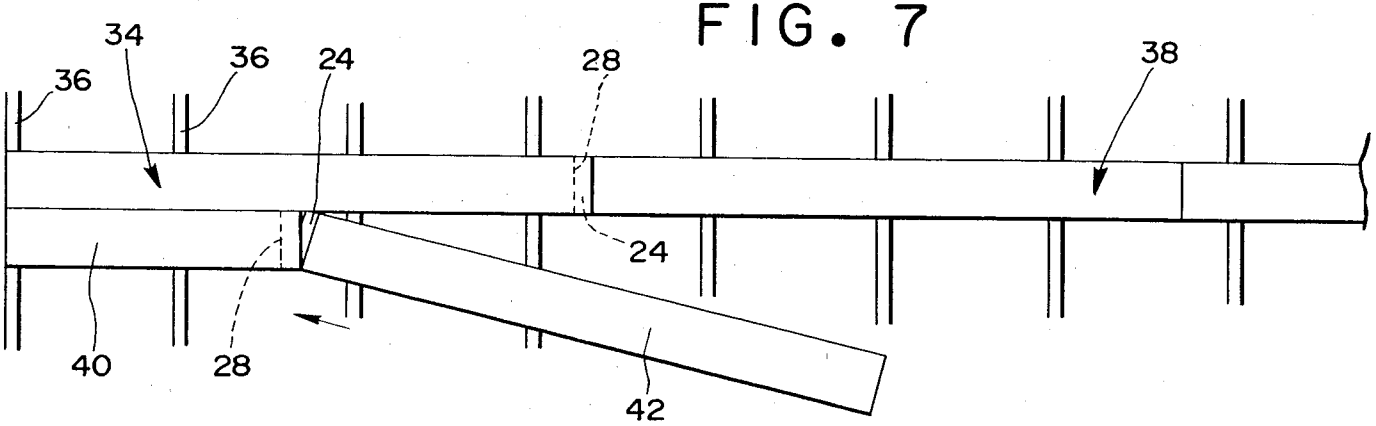
FIG. 7 is a schematic front view showing the manner of vertically and laterally connecting facing materials of the present invention to form an outer face of a wall of a building.

FIG. 5 is a schematic sectional view showing the laterally adjacent two facing materials of the illustrated embodiment connected together through the side fit-in and fit-on sections 24 and 28, FIG. 6 shows the side fit-in and fit-on sections 24 and 28 fitted together which is viewed from the side opposite to FIG. 5, and FIG. 7 is a schematic view showing the manner of fitting the side fit-in and fit-on sections with respect to each other. In FIGS. 3 and 4, reference numeral 32 designates an inner layer material such as a gypsum board, a cemented excelsor board or the like.

A first facing material 34 is fixed with respect to a support means 36 of a wall of a building by fixing the lower end of the inner wall of the lower fit-on section 14 of the facing material 34 onto the support means by means of a suitable fixing means 37 such as a screw, a nail or the like. Then, another facing material 38 laterally adjacent to the facing material 34 is fitted at the side fit-in section 24 thereof in the side fit-on section 28 of the facing material 34 to position the fit-in portion 24 of the facing material 38 on the lower connection section 20 of the facing material 34. This results in the side fit-in section 24 of the facing material 38 being securely interposed between the upper and lower connection sections 16 and 20 in the vertically direction and the connection section 30 of the side fit-on section 28 of the facing material 34 being abutted against the connection section 26 of the side fit-in section 24 of the facing material 38, to thereby connect the facing materials 34 and 38 together in the lateral direction. Further lateral connection between the facing materials 34, 38 and other facing materials is carried out in the same manner.

The manner of vertically connecting facing materials together will be described hereinafter by way of an example that lower facing materials 40 and 42 are respectively connected to the upper facing materials 34 and 38.

First, the facing material 40 is fitted at the upper fit-in section 12 in the lower fit-on section 14 of the upper facing material 34, and then both facing material 34 and 40 are securely fixed by means of a fixing means 37. Then, as shown in FIG. 7, the facing material 42 is laterally connected to the facing material 40 by fitting the side fit-in section 24 of the facing material 42 in the side fit-on section 28 of the facing material 40 at the state that the facing material 42 is downwardly inclined at the right side thereof to laterally position the facing materials 40 and 42 with respect to each other, then fitting the upper fit-in section 12 of the facing material 42 in the lower fit-on sections 14 of the facing materials 34 and 38 in the same manner as described above, and finally confirming the water-tight fitting between the side fit-in section 24 and the side fit-on section 28 of the facing material 40 and that between the upper fit-in section 12 of the facing material 42 and the lower fit-on sections 14 of the upper facing materials 34 and 38.

As described hereinbefore, the facing materials of the illustrated embodiment are adapted to be downwardly connected to one another to form an outer face of a wall of a building. Thus, it will be noted that the present embodiment allows members for connecting a scaffolding framework with a support means of a wall to be gradually downward disassembled corresponding to every formation of the downward connection between the facing materials, to thereby ensure the safe connecting operation.

Further, in the illustrated embodiment, the lateral connection among the facing materials 34, 38—may be carried out with less labor irrespective of the lateral length, because the side fit-in section 24 of the flat plate body 10 of the facing material 38 is supported on the lower connection section 20 for the lower fit-on section 24 of the facing material 34 when the side fit-in section 14 of the facing material 38 is fitted in the side fit-on section 28 of the facing material 38. In addition, when the side fit-in section 24 of the facing material is fitted in the side fit-on portion 28 of the adjacent facing material, it is securely held in the fit-on portion because it is fixedly abutted at the upper and lower ends thereof against the upper and lower connection sections 16 and 20 of the adjacent facing material and at the first connection section 26 thereof against the second connection section 30 of the adjacent facing material.

Furthermore, the lateral connection between the facing materials is carried out utilizing the side fit-in section and fit-on section simple in structure which are provided at the both side ends thereof, thus, it will be noted that the facing material can be manufactured with ease.

In the present invention, the joint between the laterally adjacent facing materials is preferably covered at the inside thereof with a caulking material to be provided with more effective water-tightness. For such purpose, it is more preferable that an elastic joint cover 44 is arranged to cover the joint in a manner to fit the side fit-on section 28 therein, as shown in FIG. 5.

Figure 8:
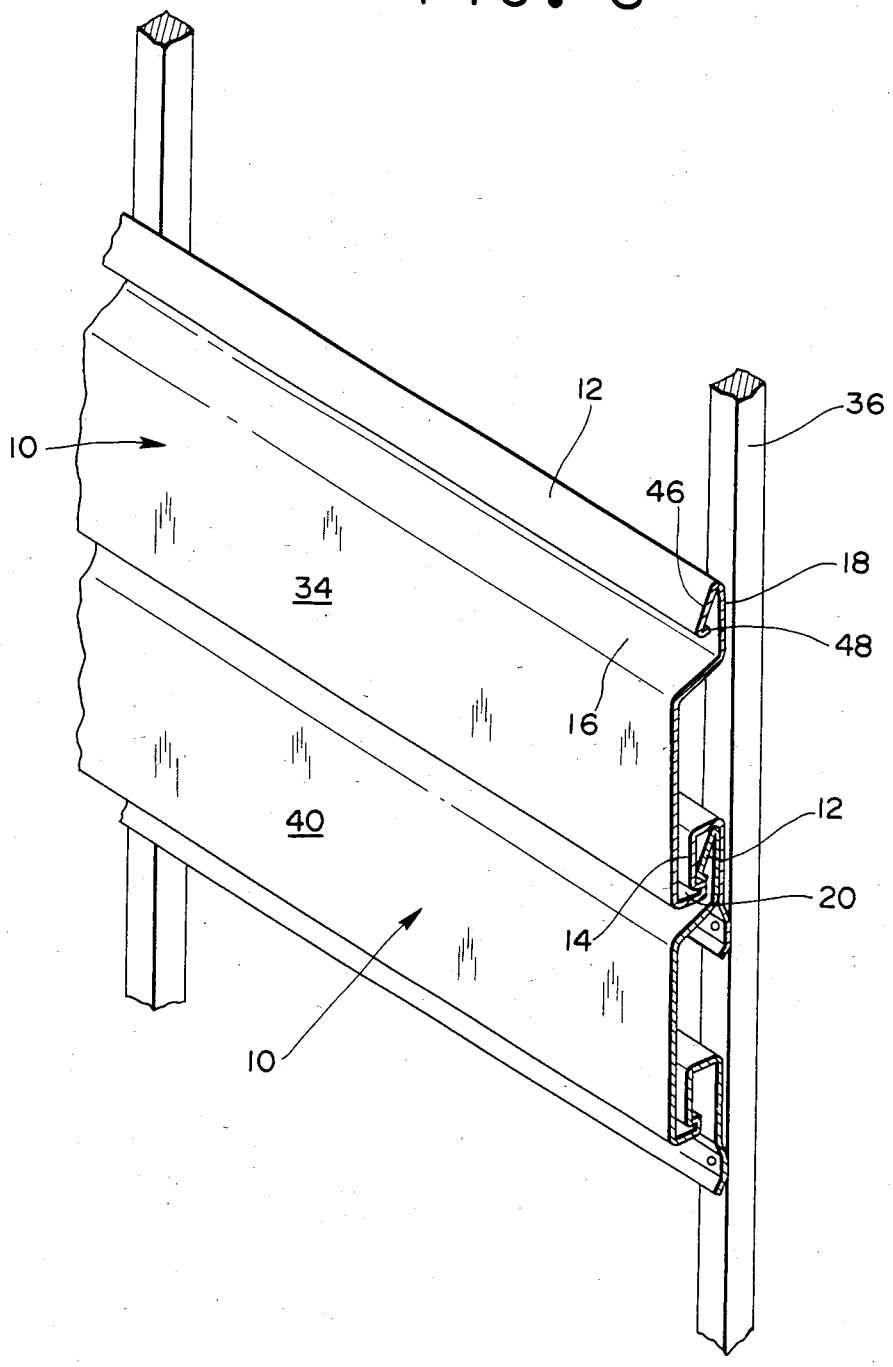
FIG. 8 is a broken perspective view in section showing another embodiment of a facing material for a building according to the present invention.

FIG. 8 is a perspective view partly in section showing another embodiment of a facing material according to the present invention. In FIG. 8, the side fit-in and fit-on sections of a facing material are omitted for clarity in description.

The embodiment shown in FIG. 8 includes a laterally extending flat plate body 10 which has an upper fit-in section 12 integrally formed at the upper end thereof along the overall longitudinal direction thereof through an upper connection section 16 upward inward extending from the upper end of the body 10. In the second embodiment, the upper fit-in section 12 comprises a rising portion 18 upward extending from the connection section 16 and a slanting portion 46 outward downward extending from the rising portion 18. The slanting portion 46 is preferably bent at the lower end thereof to form an inward turned edge 48 to prevent the edge of the slanting portion 46 from injuring the fit-on section 14 of an upward adjacent facing material. The flat plate body 10 is also formed at the inside of the lower end thereof with a lower connection section 20 and a lower fit-on section 14 in turn. The facing material of the second embodiment has an advantage of being manufactured with ease and a relatively low cost, because the bending process is readily carried out.

Figure 9:
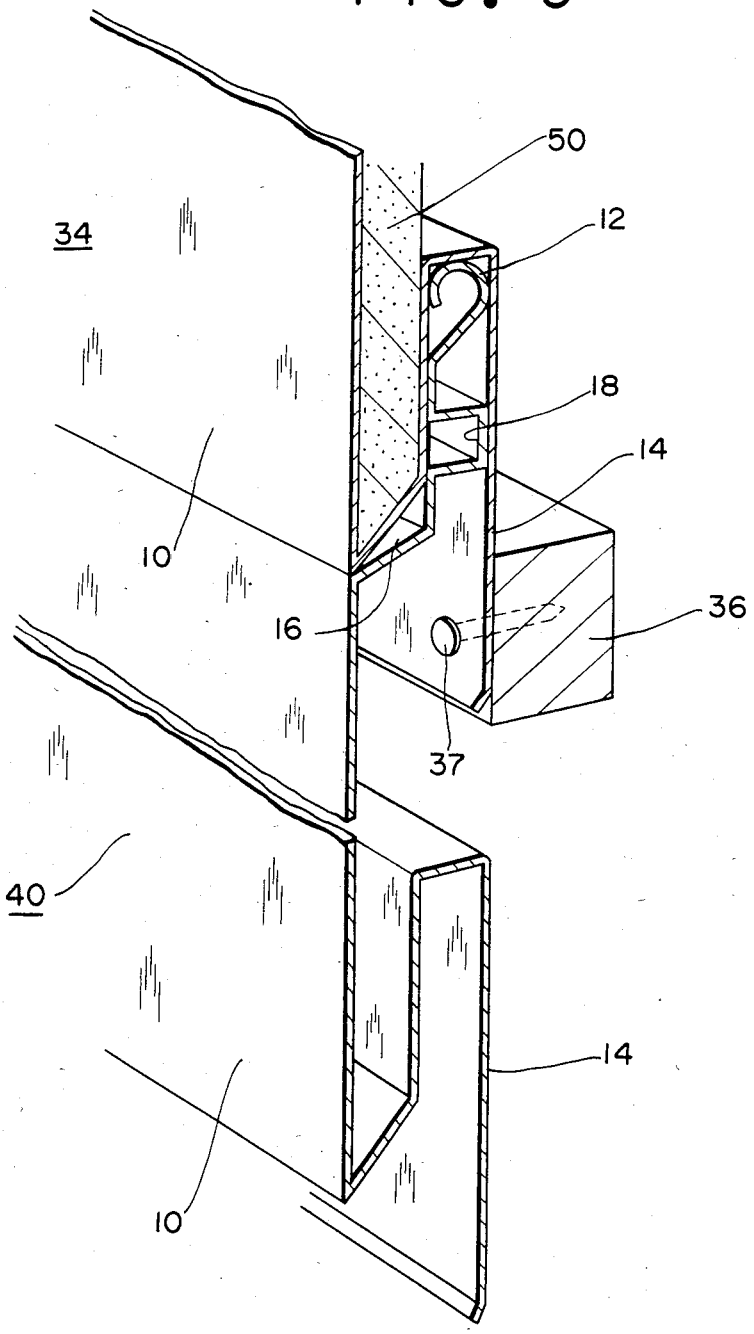
FIG. 9 is a broken perspective view in section showing a further embodiment of a facing material for a building according to the present invention.

A third embodiment of a facing material according to the present invention is shown in FIG. 9. In FIG. 9, side fit-in and fit-on sections are omitted for clarity in description as in FIG. 8. The third embodiment is adapted to allow the vertically connected facing materials to form a substantially continuous outer surface. For this purpose, a lower connection section 20 for connecting a lower fit-on section 14 to a flat plate body 10 is constructed to upward inward extend from the lower end of the flat plate 10 body, to thereby abut the lower end of the flat plate body against the upper end of a flat plate body of a lower adjacent facing material. The lower connection section 20 is preferably formed to form a space of a suitable interval between the flat plate body 10 and the lower fit-on section 14. This allows a suitable padding 50 such as glass wool or the like to be placed in the space to provide a formed wall with good heat and/or sound insulating properties. The remaining parts of the third embodiment may be constructed in the substantially same manner as the first embodiment.

The third embodiment constructed in the manner as described above can provide a formed wall with good appearance because the outer surface of the wall formed by the facing material of the embodiment is substantially flat and continuous.

As can be seen from the foregoing, the facing material of the present invention is constructed in the simple manner that the side fit-in section is formed at one end of the flat plate body so as to extend in the logitudinal direction thereof and inward project therefrom and the side fit-on section is formed at the other end of the flat plate body so as to be positioned at the inside thereof, thus, the lateral connection between the facing materials may be readily carried out.

Also, the method according to the present invention using the facing material described above is capable of forming an outer face of a wall or a roof of a building with less labor, because the vertical and lateral connection between the facing materials is readily accomplished.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A facing material for a building comprising a laterally extending flat plate body having an upper fit-in section and a lower fit-on section integrally formed at the upper and lower ends thereof in a manner to inward project from said flat plate body, respectively;

said upper fit-in section and lower fit-on section of said flat plate body being adapted to be respectively water-tightly engaged with the lower fit-on section of an upward adjacent facing material and the upper fit-on section of a downward adjacent facing material to connect the vertically adjacent facing materials to one another; and said flat plate body also having a side fit-in section integrally formed at one side end thereof in a manner to outward project from said flat plate body and a side fit-on section integrally formed at the other side end thereof in a manner to be positioned at the inside of said flat plate body, said side fit-on section of said flat plate body being adapted to allow the side fit-in section of a laterally adjacent facing material to be securely fitted therein to connect the laterally adjacent facing materials to one another, said upper fit-in section being connected through an upper connection section upward inward extending from the upper end of said flat plate body to said flat plate body, said side fit-in section being connected at the upper end thereof to said upper fit-in section, and being formed along the entire vertical direction of said flat plate body to allow the lower end thereof to be free and positioned on the same plane as an extension of the lower end of said flat plate body.

2. A facing material for a building as defined in claim 1 wherein said side fit-on portion of said flat plate body is formed along the entire vertical direction of said flat plate body.

3. A facing material for a building as defined in claim 2 wherein said facing material is formed with a space between said flat plate body and said lower fit-on section which is sufficient to arrange a padding therein.

4. A facing material for a building as defined in claim 3 wherein said lower fit-on section of said flat plate body is formed to allow a water-tight cover to be fitted on the joint between facing materials laterally connected together.

5. A facing material for a building comprising:

a laterally extending flat plate body having an upper fit-in section and a lower fit-on section integrally formed at the upper and lower ends thereof in a manner to inward project from said flat plate body and extend along the entire longitudinal direction thereof, respectively;

said upper fit-in section being connected to said flat plate body through an upper connection section upward inward extending from the upper end of said flat plate body and comprising a rising portion upward extending from said upper connection section and a wave-shaped portion upward extending from the upper end of said rising portion which are adapted to be fitted in the lower fit-on section of an upper adjacent facing material;

said lower fit-on section being connected to said flat plate body through a lower connection section horizontally inward extending from the lower end of said flat plate body and formed into a substantially inverted U-shape to receive the upper fit-in section of a downward adjacent facing material therein;

said flat plate body also having a plate-like side fit-in section formed at one side end thereof to outward extend therefrom and a side fit-on section of a substantially U-shape in cross section formed at the other side end thereof to be positioned at the inside of said flat plate body which is adapted to receive the side fit-in section of a laterally adjacent facing material therein, said side fit-in and fit-on seotions being formed along the overall vertical direction of said flat plate body;

said side fit-in section being connected to said flat plate body through a first side connection section formed to outward project from said flat plate body and connected through said first side connection section and said upper connection section to said upper fit-in section; and said side fit-on section being connected to said flat plate body through a second side connection section inward extending from said flat plate body.

6. A facing material for a building comprising:

a laterally extending flat plate body having an upper fit-in section and a lower fit-on section integrally formed at the upper and lower ends thereof in a manner to inward project from said flat plate body and extend along the entire longitudinal direction thereof, respectively;

said upper fit-in section being connected to said flat plate body through an upper connection section upward inward extending from the upper end of said flat plate body and comprising a rising portion upward extending from said upper connection section and a slanting portion outward downward extending from the upper end of said rising portion;

said lower fit-on section being connected to said flat plate body through a lower connection section horizontally inward extending from the lower end of said flat plate body and formed into a substantially inverted U-shape to receive the upper fit-in section of a downward adjacent facing material therein;

said flat plate body also having a plate-like side fit-in section formed at one side end, thereof to outward extend therefrom and a side fit-on section of a substantially U-shape in cross section formed at the other side end thereof to be positioned at the inside of said flat plate body which is adapted to receive the side fit-in section of a laterally adjacent facing material therein, said side fit-in and fit-on sections being formed along the entire vertical direction of said flat plate body;

said side fit-in section being connected to said flat plate body through a first side connection section formed to outward project from said flat plate body and connection through said first side connection section and said upper connection section to said upper fit-in section; and said side fit-on section being connected to said flat plate body through a second side connection section inward extending from said flat plate body.

7. A facing material for a building as defined in claim 6, wherein said slanting portion of said upper fit-in section is inward bent at the lower end to form an inward turned edge.

8. A facing material for a building comprising:

a laterally extending flat plate body having an upper fit-in section and a lower fit-on section integrally formed at the upper and lower ends thereof in a manner to inward project from said flat plate body and extend along the entire longitudinal direction thereof, respectively;

said upper fit-in section being connected to said flat plate body through an upper connection section upward inward extending from the upper end of said flat plate body and comprising a rising portion upward extending from said upper connection section and a wave-shaped portion upward extending from the upper end of said rising portion;

said lower fit-on section being connected to said flat plate body through a lower connection section and formed into a substantially inverted U-shape;

said lower connection section being formed to upward inward extend from the lower end of said flat plate body to allow the lower end of said flat plate body to be substantially abutted against the upper end of a flat plate body of an upward adjacent facing material when the both facing materials are vertically connected together;

said flat plate body also having a plate-like side fit-in section formed at one side end thereof to outward extend therefrom and a side fit-on section of a substantially U-shape in cross section formed at the other side end thereof to be positioned at the inside of said flat plate body which is adapted to receive the side fit-in section of a laterally adjacent material therein, said side fit-in and fit-on sections, being formed along the overall vertical direction of said flat plate body;

said side fit-in section being connected to said flat plate body through a first side connection section formed to outward project from said flat plate body and connected through said first side connection section and said upper connection section to said upper fit-in section; and said side fit-on section being connected to said flat plate body through a second side connection section inward extending from said flat plate body.

* * * * *